US007109656B2

(12) United States Patent
Woo

(10) Patent No.: US 7,109,656 B2
(45) Date of Patent: Sep. 19, 2006

(54) PLASMA DISPLAY PANEL HAVING EXTENSION ELECTRODE WITH SPECIFIC SHAPE TO INCREASE DISCHARGE EFFICIENCY

(75) Inventor: Seok-Gyun Woo, Suwon-si (KR)

(73) Assignee: Samsung SDI Co., LTD, Suwon-si (KR)

( * ) Notice: Subject to any disclaimer, the term of this patent is extended or adjusted under 35 U.S.C. 154(b) by 93 days.

(21) Appl. No.: 10/999,226

(22) Filed: Nov. 29, 2004

(65) Prior Publication Data

US 2005/0122046 A1 Jun. 9, 2005

(30) Foreign Application Priority Data

Nov. 28, 2003 (KR) ..... 10-2003-0085483

(51) Int. Cl.
*H01J 17/49* (2006.01)

(52) U.S. Cl. ..... 313/584; 313/582; 313/583

(58) Field of Classification Search ..... 313/582–587, 313/326; 315/169.4; 345/37, 41, 60, 71
See application file for complete search history.

(56) References Cited

U.S. PATENT DOCUMENTS

2004/0135508 A1* 7/2004 Kwon et al. ..... 313/582
2004/0135509 A1* 7/2004 Kwon et al. ..... 313/584
2005/0029939 A1* 2/2005 Woo et al. ..... 313/582
2005/0029941 A1* 2/2005 Kwon et al. ..... 313/582
2005/0212430 A1* 9/2005 Ahn et al. ..... 313/587

FOREIGN PATENT DOCUMENTS

JP 10 (1998) -149771 6/1998

OTHER PUBLICATIONS

Patent Abstract of Japan, Publication Number 10 (1998-149771, Published on Jun. 2, 1998, in the name of Yatsuda, et al.

* cited by examiner

*Primary Examiner*—Joseph Williams
*Assistant Examiner*—Bumsuk Won
(74) *Attorney, Agent, or Firm*—Christie, Parker & Hale, LLP

(57) ABSTRACT

A plasma display panel includes a first substrate, on which discharge sustain electrodes are formed, and an opposing second substrate, on which address electrodes are aligned in a first direction. Barrier ribs between the substrates define a plurality of discharge cells within which phosphor layers are formed. The discharge sustain electrodes have bus electrodes, forming a corresponding pair within each of the discharge cells, and extension electrodes, extending from the bus electrodes into each of the discharge cells to form an opposing pair. Each extension electrode has an end with a further extending portion with a first width $2\alpha$ and a lesser extending portion with a second width $\beta$. A distance between further extending portions defines a first gap, and a distance between lesser extending defines a second gap longer than the first gap. The first and second widths satisfy $1.5 \leqq \alpha/\beta \leqq 4$.

12 Claims, 5 Drawing Sheets

PLASMA DISPLAY PANEL HAVING EXTENSION ELECTRODE WITH SPECIFIC SHAPE TO INCREASE DISCHARGE EFFICIENCY

CROSS REFERENCE TO RELATED APPLICATION

This application claims priority to and the benefit of Korean Patent Application number 10-2003-0085483, filed on Nov. 28, 2003, the entire disclosure of which is incorporated herein by reference.

BACKGROUND OF THE INVENTION (a) Field of the Invention

The present invention relates to a plasma display panel (hereinafter, PDP), and more particularly, to a surface discharge type PDP with a electrode structure in which a pair of discharge sustain electrodes formed on one substrate and have a corresponding pair of bus electrodes within each discharge cell between two substrates to cause a display discharge.

(b) Description of the Related Art

Generally, a plasma display panel is a display device in which ultraviolet rays generated by gas discharge excite phosphors to realize predetermined images. Such a plasma display panel is popular for wide screen display devices since it enables the manufacture of large screen sizes with high resolution.

Referring to FIG. 4, a generally known PDP is formed with address electrodes 112 along one direction (in the X-axis direction of the drawing) on a rear substrate 110, and a dielectric layer 113 is formed on a surface of the rear substrate 110 covering the address electrodes 112. On the dielectric layer 113, barrier ribs 115 of stripe pattern are formed to place between each of the address electrodes 112, and red (R) , green (G), and blue (B) phosphor layers 117 are formed on each of the barrier ribs 115.

In addition, discharge sustain electrodes 102, 103 having a pair of transparent electrodes 102*a*, 103*a* and bus electrodes 102*b*, 103*b* are formed along the direction crossing the address electrodes 112 (in the Y-axis direction of the drawing) on a surface of a front substrate 100 opposing the rear substrate 110. A transparent dielectric layer 106 and a MgO protection film 108 are formed covering the discharge sustain electrodes on a surface of the front substrate 100.

The region where the address electrodes 112 on the rear substrate 110 are intersected with the discharge sustain electrodes 102, 103 on the front substrate 100 is to be a portion where discharge cells are formed.

An address voltage Va is applied between the address electrodes 112 and the discharge sustain electrodes 102, 103 to cause address discharge, and a sustain voltage Vs is applied to a pair of the discharge sustain electrodes 102, 103 to cause sustain discharge. Then, the generated vacuum ultraviolet rays excite phosphors so that they emit visible light through the front substrate 100 and thereby display PDP images.

However, the PDP having the discharge electrodes 102, 103 and the barrier ribs 115 in a stripe formation as shown in FIG. 4, may cause crosstalk between the discharge cells adjacent with the barrier ribs 115. In addition, it may cause the misdischarge between the adjacent discharge cells since the discharge areas are connected to one another along the direction where the barrier ribs 115 are formed. In order to prevent these problems, the distance between the discharge sustain electrodes 102, 103 corresponding to the adjacent pixels needs to be over a certain level, which reduces improvements in efficiency.

To solve the above problems, PDPs having improved electrodes and barrier ribs as shown in FIGS. 5 have been suggested. The PDP has a configuration such that transparent electrodes 123*a* of discharge sustain electrodes 123 are extended from bus electrodes 123*b* to face each other in a pair within each of the discharge cells. For the purpose of reducing the crosstalk between the adjacent discharge cells and enhancing the emission efficiency by increasing the phosphor coated area, a PDP is suggested which has barrier ribs 125 of the matrix type formed with vertical barrier ribs 125*a* and horizontal barrier ribs 125*b* perpendicular to each other. Japanese Patent Laid-open No. 1998-149771 describes such a plasma display panel.

The PDP having the above structure operates such that the emission of the plasma discharge starts in the sustain area between a pair of opposing discharge electrodes, and diffuses around the edge until it becomes extinct. Accordingly, the characteristics of the shape of the members forming the discharge cells have a significant influence on the sustain discharge. In particular, the shape of the discharge sustain electrodes 123 causing the sustain discharge and the barrier ribs 125 that define the shape of the discharge cells greatly influence the sustain discharge.

However, the shape of the discharge sustain electrodes 123 mentioned above causes the strong initial discharge partially in the discharge gap, and if the initial discharge occurs partially, the plasma discharge cannot be efficiently diffused within the discharge cells, and thereby the discharge efficiency deteriorates.

SUMMARY OF THE INVENTION

According to one aspect of the present invention, there is provided a PDP in which breakdown voltage is decreased by efficient layout and design of electrodes, the main discharge occurs over a large area of a discharge cell by improving partial discharge at the center, and thereby the emission efficiency can be maximized.

According to one embodiment of the present invention, the plasma display panel includes a first substrate and a second substrate opposing each other; address electrodes formed on the second substrate; barrier ribs arranged in the space between the first substrate and the second substrate to define a plurality of discharge cells; phosphor layer formed within each of the discharge cells; and discharge sustain electrodes formed on the first substrate, the discharge sustain electrodes having bus electrodes extending along the direction intersecting the direction of the address electrodes to form a corresponding pair within each of the discharge cells, and extension electrodes extending from the bus electrodes into each of the discharge cell to form an opposing pair. A pair of the discharge sustain electrodes corresponding to each of the discharge cells forms a first gap G1 and a second gap G2 having different distances from each other between the extension electrodes opposing each other, and the second gap G2 is formed to be longer than the first gap G1.

Each extension electrode has an end with a further extending portion with a first width $2\alpha$ and a lesser extending portion with a second width $\beta$. A distance between further extending portions defines a first gap, and a distance between lesser extending defines a second gap longer than the first gap. The first and second widths satisfy $1.5 \leqq \alpha/\beta \leqq 4$.

In one embodiment, the second gap G2 is formed between the centers of the opposite end portions of the extension electrodes, and each of the extension electrodes can be formed to accommodate the width in the direction of the bus electrode becoming narrower as a back end portion thereof adjacent to the bus electrode becomes further from the center of the discharge cells.

In case that the second gap G2 is formed between the centers of the opposite end portions of the extension electrodes, the end portions for forming the first gap G1 are positioned at each of both sides from the center of the opposite ends, and the width of each of the end portions for forming the first gap G1 is $\alpha$.

The distance D, between the end portion of the extension electrodes for forming the first gap G1 and the end portion of the extension electrodes for forming the second gap G2, can be formed to be in the range from 10 to 30 μm.

The extension electrode can be formed with a transparent electrode.

Furthermore, the barrier ribs arranged in the space between the first substrate and the second substrate can define non-discharge regions in addition to the plurality of discharge cells, and the non-discharge region can be formed in an area encompassed by discharge cell abscissas that pass through centers of adjacent discharge cells and discharge cell ordinates that pass through centers of adjacent discharge cells.

The non-discharge region can be formed to have independent cell structures defined by the barrier ribs, and each of the discharge cells can be formed to accommodate the widths of both end portions thereof placed in the direction of the address electrodes becoming narrower as they become further from the center of the discharge cells.

DETAILED DESCRIPTION

Figure 1:
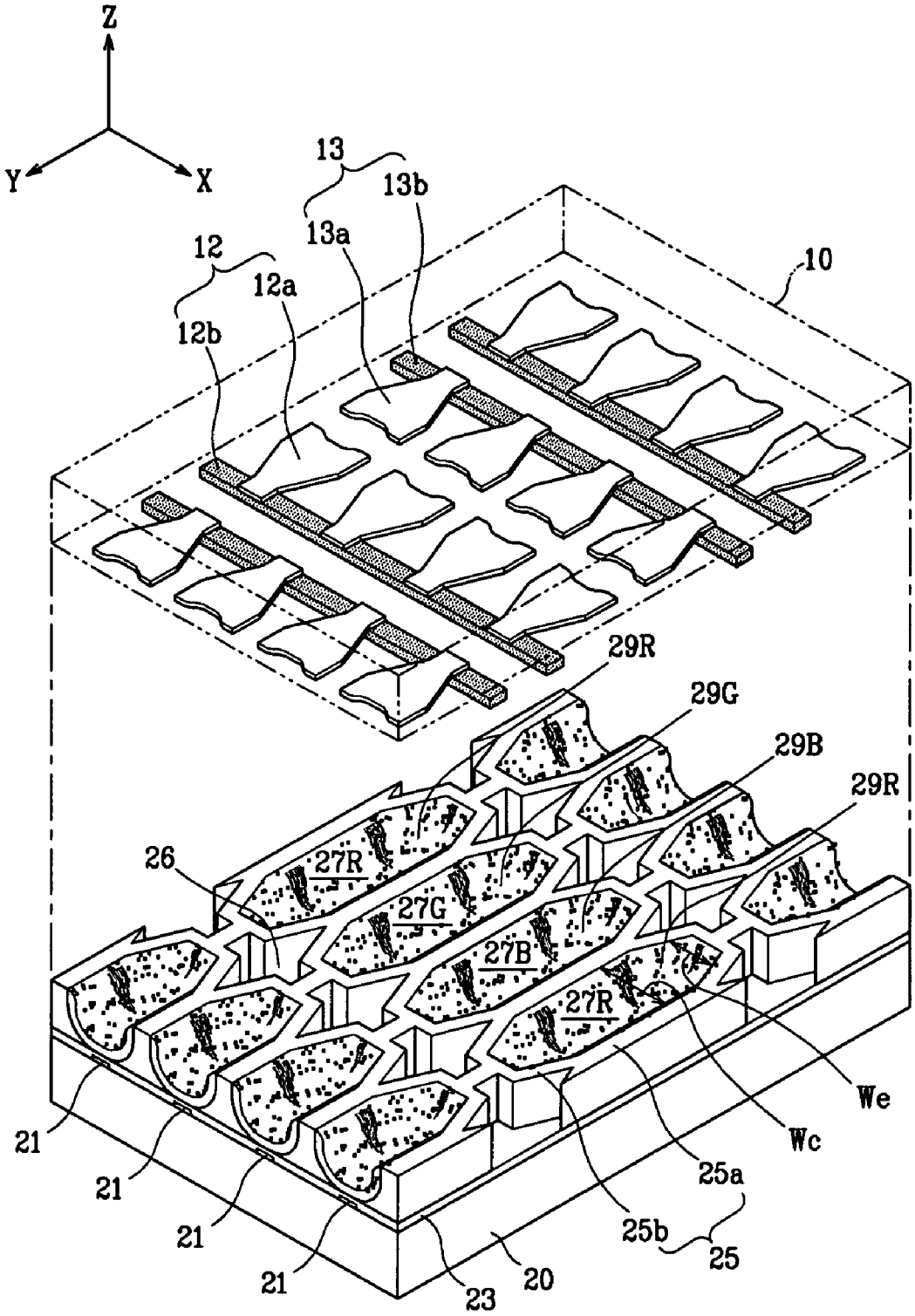
FIG. 1 is a partial exploded perspective view of a PDP according to an exemplary embodiment of the present invention.
Figure 2:
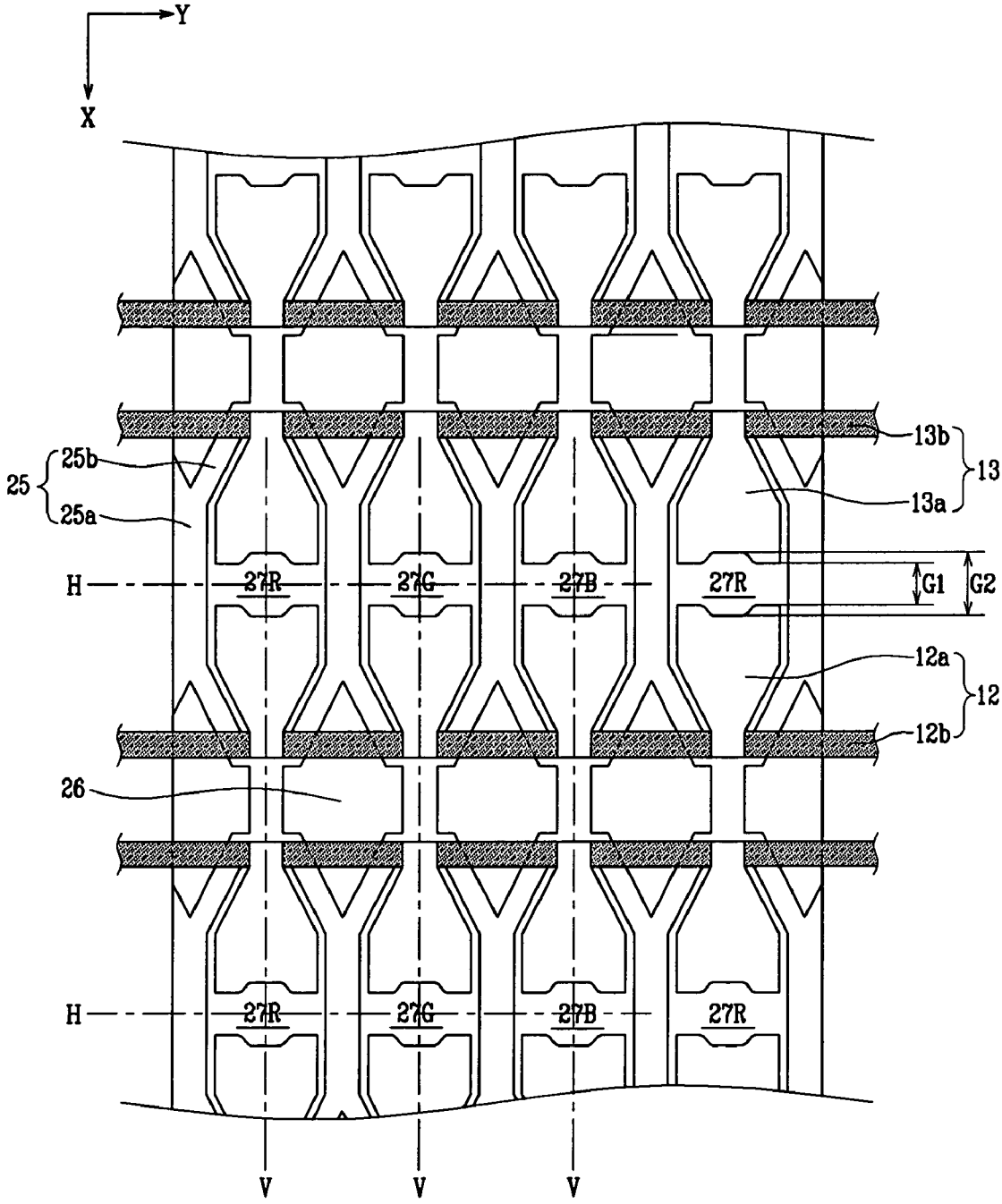
FIG. 2 is a partial plan view of the PDP according to an exemplary embodiment of the present invention.

As shown in FIGS. 1 and 2, the plasma display panel according to an exemplary embodiment of the present invention is generally formed with a first substrate 10 and a second substrate 20 which are spaced at a predetermined distance while facing each other. In the space between both of the substrates 10, 20, a plurality of discharge cells 27R, 27G, 27B are defined by barrier ribs to cause plasma discharge, and discharge sustain electrodes 12, 13 and address electrodes 21 are formed on the first substrate 10 and the second substrate 20, respectively.

In more detail, a plurality of the address electrodes 21 are formed along one direction (in the X-axis direction of the drawing) of the second substrate 20 opposing the first substrate 10. The address electrodes 21 are formed in a stripe pattern and spaced apart from the adjacent address electrodes 21 at a predetermined distance while proceeding parallel to one another. A dielectric layer 23 is also formed on the second substrate 20 where the address electrodes 21 are established. The dielectric layer 23 is formed on an entire surface of the substrate covering the address electrodes 21. It should be noted that although the address electrodes of the stripe type are mentioned above, the type of the address electrodes is not limited to this pattern and may be formed in various ways.

Barrier ribs 25 are arranged in the space between the first substrate 10 and the second substrate 20 to define a plurality of discharge cells 27R, 27G, 27B and non-discharge region 26. Preferably, the barrier ribs 25 are established on the top surface of the dielectric layer 23 formed on the second substrate 20. The discharge cells 27R, 27G, 27B designate areas in which discharge gas is provided and where gas discharge is expected to take place with the application of an address voltage and a discharge sustain voltage. The non-discharge region 26 is an area where a voltage is not applied such that gas discharge, i.e. illumination, is not expected to take place therein. In one embodiment, the non-discharge region 26 is formed to have a region which is at least greater than the width of the top portion of the barrier ribs 25.

As shown in FIG. 2, the non-discharge region 26 defined by the barrier ribs 25 is formed in an area encompassed by discharge cell abscissas H and ordinates V that pass through centers of each of the discharge cells 27R, 27G, 27B and that are respectively aligned with direction Y and direction X. In one embodiment, non-discharge region 26 is centered between adjacent abscissas H and adjacent ordinates V. Stated differently, in one embodiment each pair of discharge cells 27R, 27G, 27B adjacent to one another along direction X has a common non-discharge region 26 with another such pair of discharge cells 27R, 27G, 27B adjacent along direction Y. The non-discharge region 26 of this embodiment of the present invention is formed to have an independent cell structure by the barrier ribs 25.

The discharge cells 27R, 27G, 27B are formed to share at least one barrier rib with the adjacent discharge cell in the direction of the discharge sustain electrodes 12, 13, and they are formed to accommodate the widths of both end portions thereof (in the direction of the discharge sustain electrode, i.e. in the Y-axis direction of the drawing) placed in the direction of the address electrodes (in the X-axis direction of the drawing) becoming narrower as they become further from the center of the discharge cells 27R, 27G, 27B. That is, with reference to FIG. 1, the width Wc at the center of the discharge cell 27R, 27G, 27B is greater than the width We at the end portion, and the width We at the end portion becomes narrower further from the center of the discharge cells 27R, 27G, 27B. Both end portions of the discharge cell 27R, 27G, 27B in the direction of the address electrode 21 of the present embodiment form the shape of trapezoid, and accordingly, the overall plan shape of each of the discharge cells 27R, 27G, 27B is octagonal.

Red (R), green (G) and blue (B) phosphors are coated respectively within the inside of the discharge cells 27R, 27G, 27B to form phosphor layers 29R, 29G, 29B.

The discharge sustain electrodes 12, 13 formed on the first substrate 10 are formed with bus electrodes 12*b*, 13*b* and extension electrodes 12*a*, 13*a*. The bus electrodes 12*b*, 13*b* are arranged in a corresponding pair within each of the discharge cells 27R, 27G, 27B along the direction intersecting the direction of the address electrode 21 (in the Y-axis direction of the drawing). The extension electrodes 12*a*, 13*a* extend from the bus electrodes 12*b*, 13*b* into the inside of each of the discharge cells in an opposing pair relationship. The extension electrodes 12*a*, 13*a* have a role in causing plasma discharge within the discharge cells 27R, 27G, 27B, and in an exemplary embodiment they are formed with Indium Tin Oxide (ITO) of a transparent electrode in order to obtain a desired brightness. However, they are not limited thereto so that they can be formed with opaque, metal electrodes.

Figure 3:
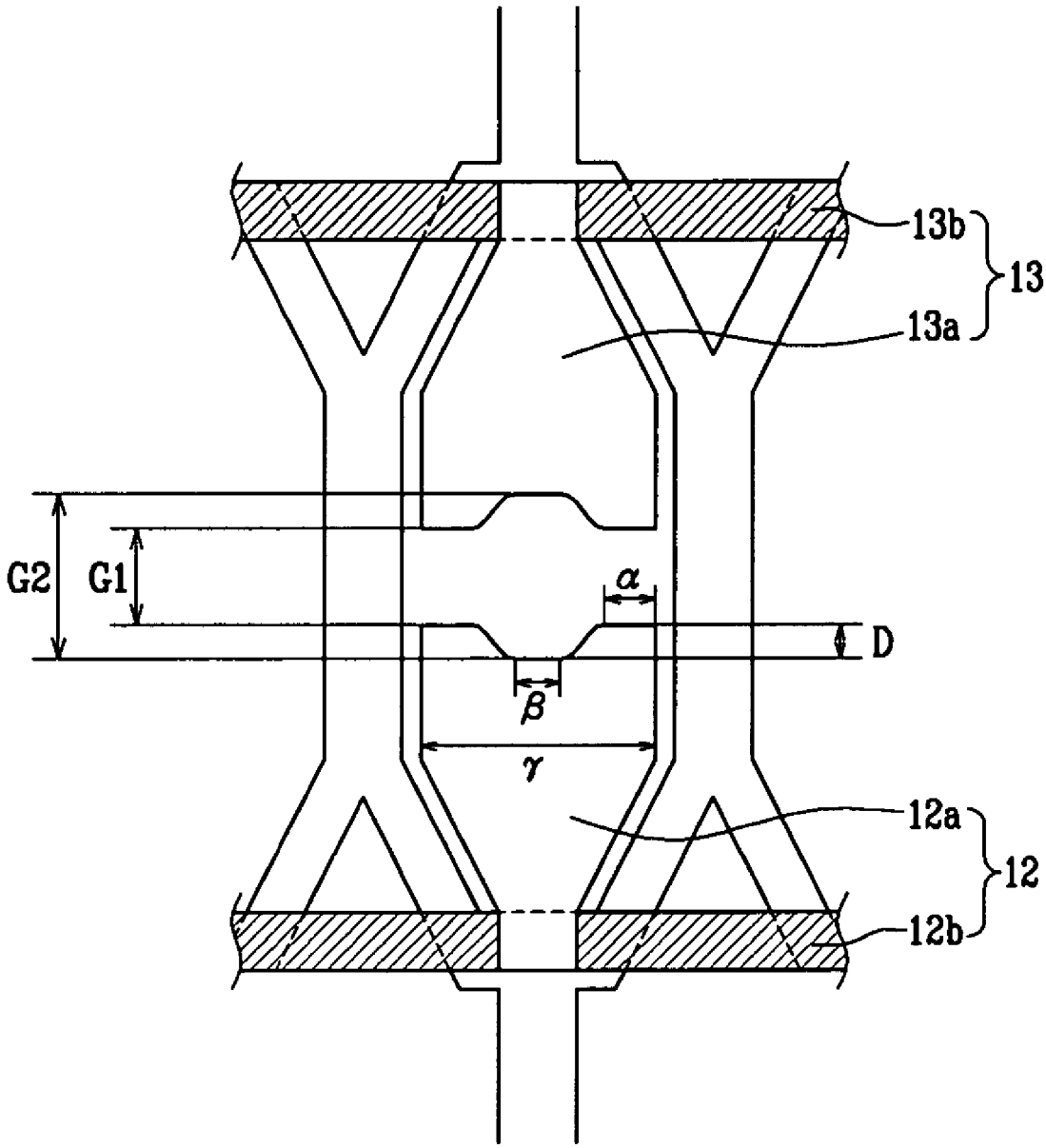
FIG. 3 is an enlarged plan view of a unit discharge cell of the PDP according to an exemplary embodiment of the present invention.
Figure 4:
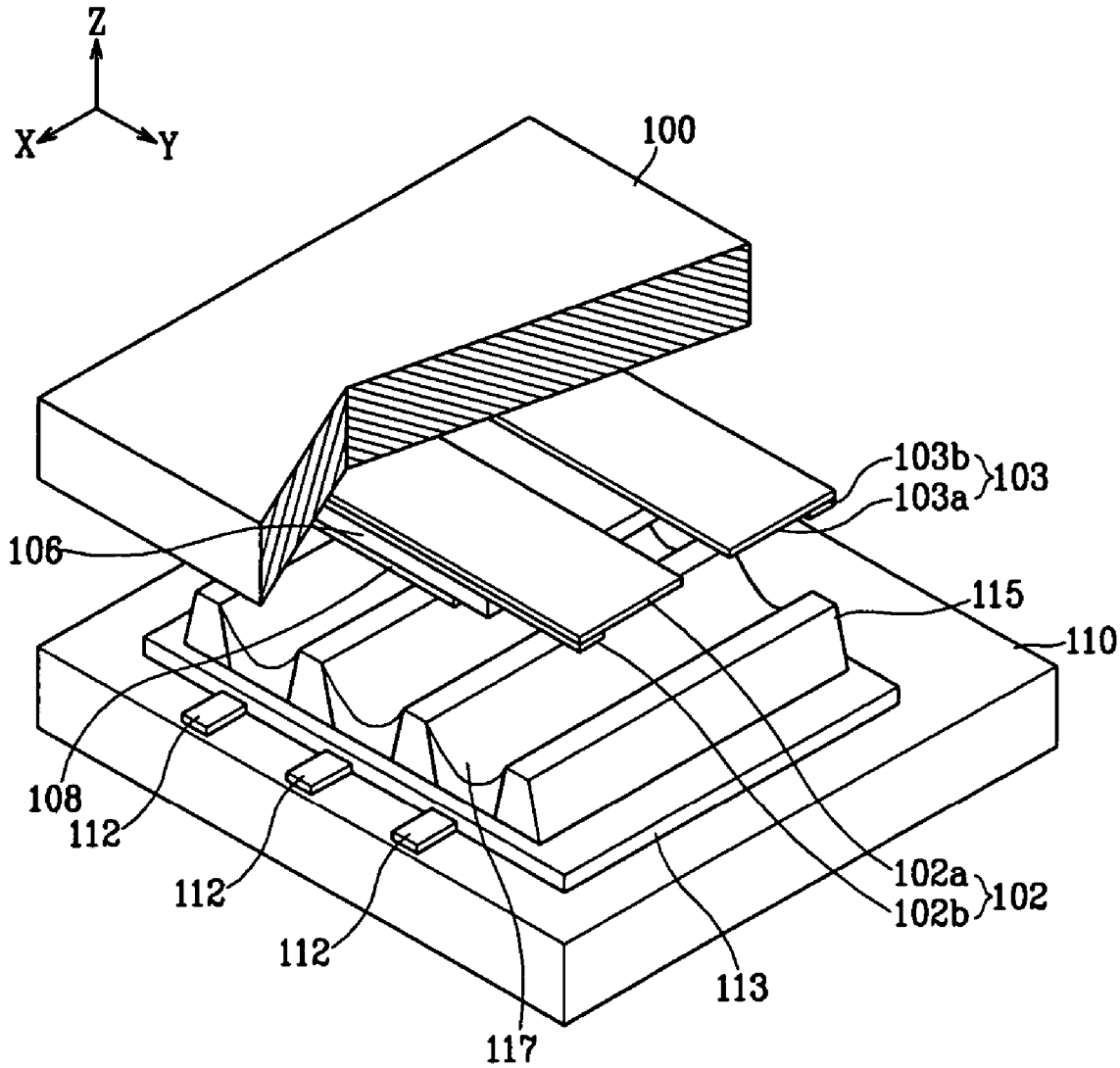
FIG. 4(Prior Art)
FIG. 4 is a partial exploded perspective view of a conventional PDP.
Figure 5:
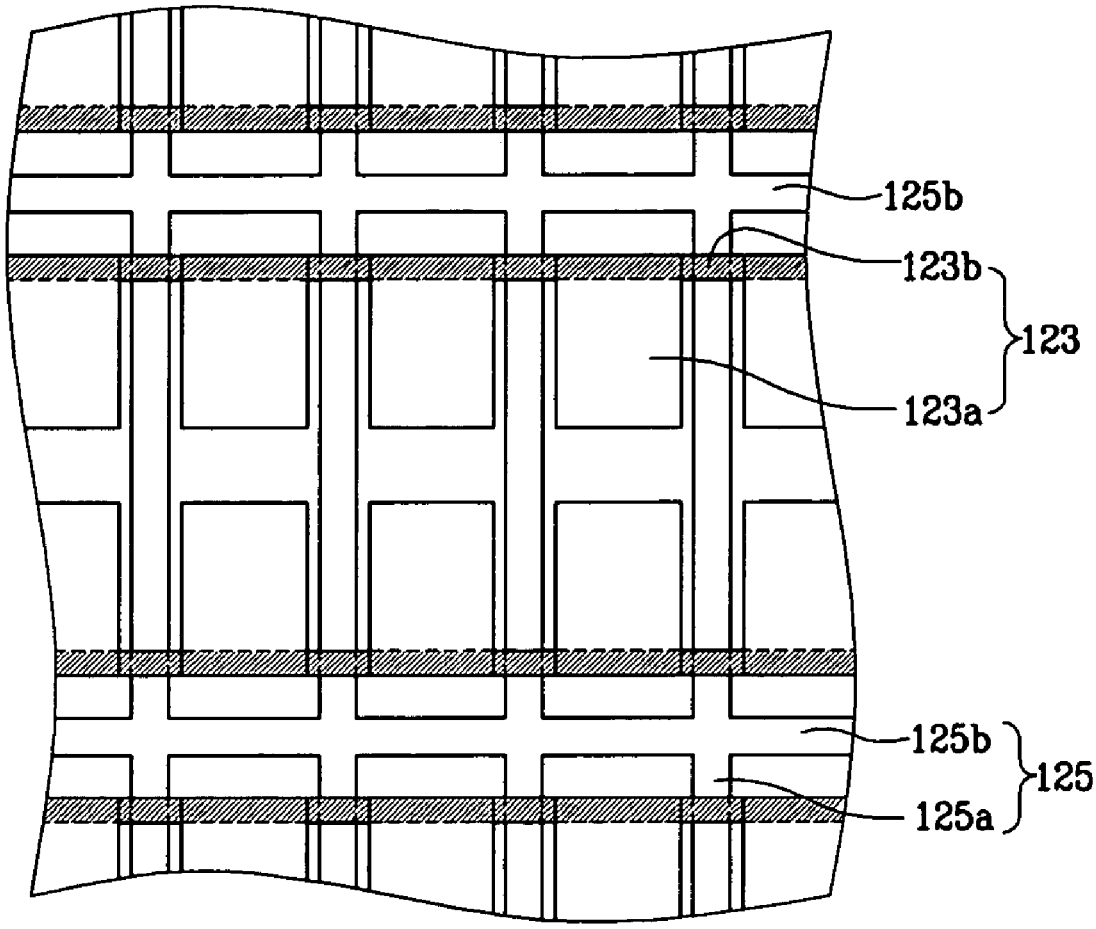
FIG.5(Prior Art)
FIG. 5 is a plan view of a conventional PDP having extension electrodes and a matrix type barrier rib structure.

With reference to FIGS. 2 and 3, a pair of the discharge sustain electrodes 12, 13 corresponding to each of the discharge cells 27R, 27G, 27B forms a first gap G1 and a second gap G2 having different distances from each other between the extension electrodes 12*a*, 13*a* opposing each other. The second gap G2 is formed to be longer than the first gap G1. The extension electrodes 12*a*, 13*a* each have a concave portion in the center of the end portion thereof, and convex portions are formed in both sides of the concave portion. Accordingly, the first gap G1 of a short gap is formed where the convex portions of a pair of the extension electrodes 12*a*, 13*a* oppose each other, and the second gap G2 of a long gap is formed where the concave portions thereof oppose each other. The main discharge starts from the first gap G1 and is spread out over the second gap G2, and thereby the discharge is diffused into the entire discharge cells 27R, 27G, 27B.

Since the first gap G1 of the extension electrodes 12*a*, 13*a* enables closing of the distance between the ends of the opposing extension electrodes 12*a*, 13*a* without deterioration of the aperture ratio, the voltage necessary for discharge can be lowered. The second gap G2 has a role in stably discharging by concentrating the discharge at the center thereof.

Each of the extension electrodes 12*a*, 13*a* is formed to accommodate the width in the direction of the bus electrodes 12*b*, 13*b* (in the Y-axis direction in the drawing) becoming narrower as a back end portion thereof adjacent to the bus electrodes 12*b*, 13*b* becomes further from the center of the discharge cells 27R, 27G, 27B. Since the portion where the extension electrodes 12*a*, 13*a* are connected to the bus electrodes 12*b*, 13*b* makes little contribution to the discharge efficiency, the width thereof can be formed to be narrower than that of the ends to improve the discharge efficiency and to secure the aperture ratio.

With reference to FIG. 3, it will now be described how to determine the optimum values for designing electrodes. The first gap G1 is formed between further extending end portions of the extension electrodes 12*a*, 13*a*. Each extension electrode 12*a*, 13*a* has right and left sides of its end portions that extend toward the first gap G1. If the widths of the extending right and left sides are a, the total width of the right and left sides forming the first gap G1 is 2α. A second, larger gap G2 is formed between lesser extending end portions of the extension electrodes 12*a*, 13*a*. If the width of this lesser extending end portion of the extension electrode 12*a*, 13*a* is β, then A=α/β is defined.

The distance in extension between the further extending end portion of the extension electrodes 12*a*, 13*a*, for forming the first gap G1, and the lesser extending end portion, for forming the second gap G2, is defined as D.

A, α, β, D are factors affecting the discharge characteristics and are defined as above. These factors are varied based on a 42 inch panel, and the discharge efficiency and the number of misdischarge have been measured as shown in Table 1 through Table 3. In particular, Table 1 shows the discharge efficiency and the number of misdischarge with varying the value of A when D=10 μm. Table 2 shows the discharge efficiency and misdischarges when D=20 μm, and Table 3 shows the discharge efficiency and misdischarges when D=30 μm. The discharge efficiency is expressed as a relative value which becomes 2 when the value of A is 2.5. The number of misdischarge is an average of the number of misdischarge for 60 frames within the 8×8 discharge cells. The value of A was varied from 0.3 to 10 in experiments conducted, and the tables below show the results of the experiments when the value of A was varied from 0.3 to 5.

TABLE 1

| A(=α/β) | Discharge Efficiency | No. of Misdischarge |
|---|---|---|
| 0.3 | 1.30 | 8 |
| 0.5 | 1.33 | 9 |
| 0.7 | 1.32 | 8 |
| 0.8 | 1.37 | 8 |
| 1 | 1.41 | 7 |
| 1.2 | 1.43 | 3 |
| 1.4 | 1.46 | 2 |
| 1.5 | 1.71 | 1 |
| 1.7 | 1.73 | 2 |
| 1.9 | 1.76 | 0 |
| 2 | 1.80 | 0 |
| 2.1 | 1.84 | 0 |
| 2.2 | 1.90 | 0 |
| 2.3 | 1.94 | 0 |
| 2.4 | 1.96 | 0 |
| 2.5 | 2.00 | 0 |
| 2.6 | 2.15 | 0 |
| 2.7 | 2.22 | 0 |
| 2.8 | 2.24 | 0 |
| 2.9 | 2.22 | 0 |
| 3 | 2.22 | 0 |
| 3.1 | 2.21 | 0 |
| 3.2 | 2.21 | 0 |
| 3.3 | 2.12 | 0 |
| 3.4 | 2.07 | 0 |
| 3.5 | 1.96 | 0 |
| 3.6 | 1.95 | 0 |
| 3.7 | 1.93 | 0 |
| 3.8 | 1.90 | 0 |
| 3.9 | 1.87 | 0 |
| 4 | 1.87 | 0 |
| 4.1 | 1.86 | 0 |
| 4.2 | 1.53 | 0 |
| 4.3 | 1.53 | 0 |
| 4.4 | 1.51 | 0 |
| 4.5 | 1.53 | 0 |
| 4.6 | 1.52 | 0 |
| 4.7 | 1.49 | 0 |
| 4.8 | 1.50 | 0 |
| 4.9 | 1.52 | 0 |
| 5 | 1.49 | 0 |

TABLE 2

| A(=α/β) | Discharge Efficiency | No. of Misdischarge |
|---|---|---|
| 0.3 | 1.31 | 9 |
| 0.5 | 1.32 | 10 |
| 0.7 | 1.31 | 8 |
| 0.8 | 1.34 | 8 |
| 1 | 1.39 | 10 |
| 1.2 | 1.42 | 7 |
| 1.4 | 1.66 | 3 |
| 1.5 | 1.68 | 2 |
| 1.7 | 1.72 | 2 |
| 1.9 | 1.75 | 1 |
| 2 | 1.79 | 1 |
| 2.1 | 1.83 | 0 |
| 2.2 | 1.89 | 0 |
| 2.3 | 1.92 | 0 |
| 2.4 | 1.95 | 0 |
| 2.5 | 2.00 | 0 |
| 2.6 | 2.20 | 0 |
| 2.7 | 2.23 | 0 |
| 2.8 | 2.24 | 0 |
| 2.9 | 2.23 | 0 |
| 3 | 2.22 | 0 |
| 3.1 | 2.23 | 0 |
| 3.2 | 2.21 | 0 |

TABLE 2-continued

| A(=α/β) | Discharge Efficiency | No. of Misdischarge |
|---|---|---|
| 3.3 | 2.10 | 0 |
| 3.4 | 2.06 | 0 |
| 3.5 | 1.95 | 0 |
| 3.6 | 1.96 | 0 |
| 3.7 | 1.91 | 0 |
| 3.8 | 1.86 | 0 |
| 3.9 | 1.87 | 0 |
| 4 | 1.86 | 0 |
| 4.1 | 1.85 | 0 |
| 4.2 | 1.54 | 0 |
| 4.3 | 1.54 | 0 |
| 4.4 | 1.52 | 0 |
| 4.5 | 1.53 | 0 |
| 4.6 | 1.53 | 0 |
| 4.7 | 1.49 | 0 |
| 4.8 | 1.51 | 0 |
| 4.9 | 1.52 | 0 |
| 5 | 1.48 | 0 |

TABLE 3

| A(=α/β) | Discharge Efficiency | No. of Misdischarge |
|---|---|---|
| 0.3 | 1.29 | 10 |
| 0.5 | 1.31 | 11 |
| 0.7 | 1.32 | 9 |
| 0.8 | 1.35 | 8 |
| 1 | 1.38 | 7 |
| 1.2 | 1.61 | 3 |
| 1.4 | 1.63 | 2 |
| 1.5 | 1.66 | 3 |
| 1.7 | 1.70 | 2 |
| 1.9 | 1.76 | 2 |
| 2 | 1.80 | 1 |
| 2.1 | 1.85 | 0 |
| 2.2 | 1.88 | 0 |
| 2.3 | 1.96 | 0 |
| 2.4 | 1.97 | 0 |
| 2.5 | 2.00 | 0 |
| 2.6 | 2.09 | 0 |
| 2.7 | 2.17 | 0 |
| 2.8 | 2.22 | 0 |
| 2.9 | 2.26 | 0 |
| 3 | 2.26 | 0 |
| 3.1 | 2.27 | 0 |
| 3.2 | 2.23 | 0 |
| 3.3 | 2.20 | 0 |
| 3.4 | 2.06 | 0 |
| 3.5 | 1.95 | 0 |
| 3.6 | 1.94 | 0 |
| 3.7 | 1.92 | 0 |
| 3.8 | 1.88 | 0 |
| 3.9 | 1.87 | 0 |
| 4 | 1.85 | 0 |
| 4.1 | 1.65 | 0 |
| 4.2 | 1.56 | 0 |
| 4.3 | 1.52 | 0 |
| 4.4 | 1.52 | 0 |
| 4.5 | 1.54 | 0 |
| 4.6 | 1.53 | 0 |
| 4.7 | 1.48 | 0 |
| 4.8 | 1.50 | 0 |
| 4.9 | 1.53 | 0 |
| 5 | 1.43 | 0 |

As shown in Table 1, when the value of D is 10 μm and the value of A is in the range of $1.5 \leqq A \leqq 4.1$, the discharge efficiency is proper and misdischarges are rare.

As shown in Table 2, when the value of D is 20 μm and the value of A is in the range of $1.4 \leqq A \leqq 4.1$, the discharge efficiency is proper and misdischarges are rare.

As shown in Table 3, when the value of D is 30 μm and the value of A is in the range of $1.2 \leqq A < 4$, the discharge efficiency is proper and misdischarges are rare, In each case, if the value of A is below the proper value, the width of the further extending end portions, for forming the first gap G1 of a short gap, is decreased so that the uniform discharge of the surface discharge cannot be achieved and the number of misdischarge is increased. If the value of A is over the proper value, the lesser extending end portions, for forming the second gap G2 of a long gap, is decreased, it becomes difficult for the long gap to discharge so that the discharge efficiency is decreased.

Accordingly, the common optimum value for A calculated from Table 1 through Table 3 is in the range of $1.5 \leqq A \leqq 4$, and if the value of A falls in this range, the proper value for design can be obtained which has advantages of high efficiency and reduction of misdischarge independent of the value of D.

As described above, in the plasma display panel according to the present invention, a pair of the discharge sustain electrodes corresponding each of the discharge cells forms the gaps G1, G2 which have different distances from each other, and the designs for the end portions of the extension electrodes corresponding these gaps are optimized, and thereby the discharge efficiency can be improved.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel comprising:

a first substrate and a second substrate opposing each other;

address electrodes formed on the second substrate and aligned in a first direction;

barrier ribs arranged between the first substrate and the second substrate to define a plurality of discharge cells;

a phosphor layer formed within each of the discharge cells; and discharge sustain electrodes formed on the first substrate, the discharge sustain electrodes having bus electrodes extending along a direction intersecting the first direction to form a corresponding pair within each discharge cell, and extension electrodes extending from the bus electrodes into each discharge cell to form an opposing pair, each extension electrode having an end with a further extending portion with a first width 2α, and a lesser extending portion with a second width β, wherein a distance between further extending portions in each opposing pair of extension electrodes defines a first gap, and a distance between lesser extending portions in each opposing pair of extension electrodes defines a second gap, the second gap longer than the first gap, and wherein the first width and the second width satisfy $1.5 \leqq \alpha/\beta \leqq 4$.

2. The plasma display panel of claim 1, wherein the lesser extending portions are near the centers of the extension electrode ends.

3. The plasma display panel of claim 2, wherein the further extending portions are positioned at both sides of the centers of the extension electrode ends.

4. The plasma display panel of claim 1, wherein widths of the extension electrodes becomes narrower further from the center of the discharge cells.

5. The plasma display panel of claim 1, wherein the value of D is formed to be in the range from 10 to 30 μm, where D is the distance between the further extending portion and the lesser extending portion of each extension electrode.

6. The plasma display panel of claim 1, wherein the extension electrode is formed as a transparent electrode.

7. The plasma display panel of claim 1, wherein the barrier ribs further define non-discharge regions formed in an area encompassed by discharge cell abscissas, that pass through centers of adjacent discharge cells, and discharge cell ordinates, that pass through centers of adjacent discharge cells in a direction that intersects a direction of the discharge cell abscissas.

8. The plasma display panel of claim 7, wherein the non-discharge region is formed to have independent cell structures defined by the barrier ribs.

9. The plasma display panel of claim 7, wherein each of the discharge cells is formed to accommodate the widths of both end portions thereof placed in the direction of the address electrodes becoming narrower as they become further from the center of the discharge cells.

10. The plasma display panel of claim 7, wherein the second gap is formed between centers of the opposing ends of the extension electrodes.

11. The plasma display panel of claim 10, wherein the first gap is formed between two projections on either side of the centers, the widths of each of the projections equal to $\alpha$, and wherein the two projections make up the lesser extending portion.

12. The plasma display panel of claim 7, wherein widths of the extension electrodes becomes narrower further from the center of the discharge cells.

* * * * *